US008899361B2

(12) United States Patent
Goto

(10) Patent No.: US 8,899,361 B2
(45) Date of Patent: Dec. 2, 2014

(54) UPPER SLEWING BODY AND HYBRID CONSTRUCTION MACHINE INCLUDING SAME

(75) Inventor: Naoki Goto, Hiroshima (JP)

(73) Assignee: Kobelco Construction Machinery Co., Ltd., Hiroshima-shi (JP)

( * ) Notice: Subject to any disclaimer, the term of this patent is extended or adjusted under 35 U.S.C. 154(b) by 0 days.

(21) Appl. No.: 14/002,180

(22) PCT Filed: Feb. 28, 2012

(86) PCT No.: PCT/JP2012/001353

§ 371 (c)(1),
(2), (4) Date: Aug. 29, 2013

(87) PCT Pub. No.: WO2012/120833

PCT Pub. Date: Sep. 13, 2012

(65) Prior Publication Data

US 2013/0333963 A1 Dec. 19, 2013

(30) Foreign Application Priority Data

Mar. 4, 2011 (JP) ..... 2011-048280

(51) Int. Cl.

| | |
|---|---|
| ***B60K 6/20*** | (2007.10) |
| ***B60K 5/00*** | (2006.01) |
| ***B60K 1/00*** | (2006.01) |
| ***E02F 9/08*** | (2006.01) |
| ***E02F 9/20*** | (2006.01) |

(52) U.S. Cl.

CPC ..... *E02F 9/2075* (2013.01); *E02F 9/0883* (2013.01); *E02F 9/0858* (2013.01)

USPC ..... 180/65.21; 180/65.22; 180/68.5

(58) Field of Classification Search

CPC ..... B60K 1/04; B60K 5/00; B60K 6/00; B60K 15/003; B60K 2001/005; B60K 6/20

USPC ..... 180/65.21, 65.22, 68.5

See application file for complete search history.

(56) References Cited

U.S. PATENT DOCUMENTS

| | | | | |
|---|---|---|---|---|
| 7,500,532 | B2 * | 3/2009 | Koga et al. | 180/89.13 |
| 2004/0098983 | A1 * | 5/2004 | Naruse et al. | 60/428 |

FOREIGN PATENT DOCUMENTS

| | | |
|---|---|---|
| JP | 2004 169465 | 6/2004 |
| JP | 2010 222814 | 10/2010 |
| JP | 2011 20833 | 2/2011 |

OTHER PUBLICATIONS

International Search Report Issued Jun. 5, 2012 in PCT/JP12/001353 filed Feb. 28, 2012.

*Primary Examiner* — J. Allen Shriver, II
*Assistant Examiner* — Bryan Evans
(74) *Attorney, Agent, or Firm* — Oblon, Spivak, McClelland, Maier & Neustadt, L.L.P.

(57) ABSTRACT

To ensure that an electric power cable and a signal cable are laid easily over short distances while suppressing an effect of electromagnetic wave noise on the signal cable, an electric power cable is laid along a route that passes through only a right outside space in a lower position than an upper end of a right vertical plate, while a signal cable is laid along a bypass route that extends from a generator motor in a lower position than the upper end of the right vertical plate, passes through a rear portion cable insertion hole into an intermediate space between the right vertical plate and a left vertical plate, and returns to the right outside space from the intermediate space through a front portion cable insertion hole.

8 Claims, 5 Drawing Sheets

UPPER SLEWING BODY AND HYBRID CONSTRUCTION MACHINE INCLUDING SAME

TECHNICAL FIELD

The present invention relates to a wiring structure of an electric power system and a signal system for connecting hybrid devices to each other in a hybrid construction machine that uses both power generated by an engine and electric power.

BACKGROUND ART

FIG. 4 is a side view showing an overall configuration of a hybrid shovel serving as an example of a hybrid construction machine. FIG. 5 is a plan view showing an example of a layout of devices on an upper frame, the layout being envisaged in the hybrid construction machine shown in FIG. 4.

As shown in FIG. 4, the shovel includes a crawler type lower propelling body 1, an upper slewing body 2 provided on the lower propelling body 1 to be capable of slewing about a perpendicular axis to a ground surface, and a working attachment 6 provided on a front portion of the upper slewing body 2. The working attachment 6 includes a boom 3, an arm 4, and a bucket 5.

As shown in FIG. 5, the upper slewing body 2 includes an upper frame 7 serving as a base, a cabin 8 provided on a front portion left side of the upper frame 7, and a counterweight 9 provided in a rear end portion of the upper frame 7.

Note that in this specification, "front-rear" and "left-right" indicate directions seen from an operator sitting in the cabin 8.

The upper slewing body 2 also includes a partition plate 10 extending in the left-right direction behind the cabin 8, an engine 12 serving as a power source and disposed in an engine room 11 formed between the partition plate 10 and the counterweight 9, and a hydraulic pump 14 driven by power from the engine 12. The engine 12 is disposed in a lateral attitude such that an output shaft thereof extends in the left-right direction.

The upper slewing body 2 of the hybrid shovel further includes a generator motor 13 provided on the upper frame 7 on one side (a right side in the drawing; the following description, including the embodiment, is based on this example) of the engine 12 in the left-right direction. The generator motor 13 is capable of operating as both a generator and a motor. More specifically, the generator motor 13 is driven as a generator by the power of the engine 12. Further, the generator motor 13 is arranged with respect to the hydraulic pump 14 in the left-right direction.

Note that an engine cooling radiator, a cooling fan, and so on are provided on a left side of the engine 12. These components are not directly related to the present invention, and have therefore been omitted from the drawings.

The upper slewing body 2 further includes left and right vertical plates 15, 16 that stand on the upper frame 7 in a left-right direction intermediate portion of the upper frame 7 with a left-right direction interval, and extend over substantially an entire front-rear direction length of the upper frame 7. The boom 3 shown in FIG. 4 is attached to front portions of the both vertical plates 15, 16.

Further, as shown in the drawing, the generator motor 13 is disposed on an inner side of the right vertical plate 16 (between the right vertical plate 16 and the left vertical plate 15).

Furthermore, the upper slewing body 2 includes a fuel tank 17, an operating oil tank 18, an electric storage device 19, and a control device 20. The fuel tank 17 and the operating oil tank 18 are arranged on the upper frame 7 in the front-rear direction on an outer side of the right vertical plate 16 (an outer side in a width direction of the upper slewing body 2, i.e. on the right side of the right vertical plate 16). The electric storage device 19 is provided in front of the tanks 17, 18, in other words on a front portion right side of the upper frame 7, and serves as a power source for operating the generator motor 13 as a motor. The control device 20 controls operations of the electric storage device 19 and the generator motor 13.

In other words, the generator motor 13, the electric storage device 19, and the control device 20 constitute hybrid devices. Of these hybrid devices, the generator motor 13 is disposed in a rear portion of the upper frame 7 while the electric storage device 19 and the control device 20 are disposed in the front portion of the upper frame 7.

When there is no particular need to differentiate between the electric storage device 19 and the control device 20 in the following description of the present invention, including the embodiment, these two components will occasionally be referred to collectively as a "front portion hybrid device". A reference numeral "21" in FIGS. 1, 2, 5, and 6 denotes the front portion hybrid device collectively.

Note that the layout described above, in which the electric storage device 19 and the control device 20 are disposed on the front portion right side of the upper frame 7, is an example of a layout envisaged for use in a hybrid shovel. Another example of a layout of a electric storage device and a control device is disclosed in Patent Document 1.

FIG. 6 is a schematic plan view showing an example of wiring in an electric power system and a signal system for connecting the devices on the upper frame, the example being envisaged in the hybrid construction machine shown in FIGS. 4 and 5. Note that the partition plate 10 and the engine room 11 shown in FIG. 5 have been omitted from FIG. 6.

A reference symbol S1 in FIG. 6 denotes an intermediate space sandwiched between the left and right vertical plates 15, 16. Further, a reference symbol S2 denotes a right outside space on an outer side (the right side) of the right vertical plate 16. A reference symbol S3 denotes a left outside space on an outer side (the left side) of the left vertical plate 15.

As shown in FIG. 6, the upper slewing body 2 includes an electric power cable 22 and a signal cable 23 for electrically connecting the generator motor 13 to the front portion hybrid device 21. The electric power cable 22 transmits electric power between the generator motor 13 and the front portion hybrid device 21 (the electric storage device 19). The signal cable 23 transmits signals such as a control signal and a sensor signal between the generator motor 13 and the front portion hybrid device 21 (the control device 20).

Electromagnetic wave noise is generated in the electric power cable 22 by a high voltage large current flowing through the electric power cable 22, and this electromagnetic wave noise adversely affects the signal cable 23, through which a weak current flows. As a result, signal transmission may be obstructed.

As shown in FIG. 6, therefore, it is thought that the two cables 22, 23 are laid along separate routes in order to suppress the effect of the electromagnetic wave noise on the signal cable 23.

More specifically, the electric power cable 22 is laid along a route as follows. The route starts from the intermediate space S1 in which the generator motor 13 is disposed, passes through the right vertical plate 16 into the right outside space S2, and then passes through the right outside space S2 along the right vertical plate 16 until reaching the front portion hybrid device 21.

The signal cable 23, meanwhile, is laid along a bypass route as follows. The bypass route starts from the intermediate space S1, passes through the left vertical plate 15 into the left outside space S3, extends along the left vertical plate 15 until reaching a front portion of the left outside space S3, passes through the left vertical plate 15 into the intermediate space S1, passes through the right vertical plate 16 into the right outside space S2, and then reaches the front portion hybrid device 21.

In other words, the two cables 22, 23 are laid along routes set such that the two cables 22, 23 are as far removed from each other as possible by the two vertical plates 15, 16, which are constituted by conductors (steel plates) capable of blocking electromagnetic wave noise.

According to the wiring structure described above, however, the signal cable 23 is laid along a long-distance bypass route that passes through the three spaces S1 to S3. More specifically, the signal cable 23 is laid along a long-distance bypass route passing through the left outside space S3, the intermediate space S1, and then the right outside space S2 from the intermediate space S1. The electric power cable 22 is also disposed along a comparatively long route extending from the intermediate space Si to the right outside space S2. The respective cables 22, 23 must therefore be laid so as to avoid the devices disposed compactly on these long routes. As a result, a wiring operation becomes extremely complicated. Further, there also be a defect in which a required cost of the wiring becomes increase by increasing a required cable length.

Patent Document 1: Japanese Unexamined Patent Application No. 2004-169465

SUMMARY OF THE INVENTION

An object of the present invention is to provide an upper slewing body and a hybrid construction machine including the upper slewing body, with which an electric power cable and a signal cable can be laid easily over short distances while suppressing an effect of electromagnetic wave noise on the signal cable.

To solve the problems described above, the present invention provides an upper slewing body for a hybrid construction machine, which is provided rotatably on a lower propelling body, the upper slewing body including: an upper frame; a first vertical plate and a second vertical plate forming a left-right pair and having conductivity, which stand on the upper frame in a left-right direction intermediate portion of the upper frame with a left-right direction interval, and extend over substantially an entire front-rear direction length of the upper frame; an engine provided in a rear portion of the upper frame; a generator motor that is provided in the rear portion of the upper frame and can be operated as a generator using power from the engine; an electric storage device that is provided in a front portion of the upper frame and constitutes a power source for operating the generator motor as a motor; a control device provided in the front portion of the upper frame to control operations of the electric storage device and the generator motor; an electric power cable that connects the electric storage device to the generator motor in order to transmit electric power therebetween; and a signal cable that connects the control device to the generator motor in order to transmit signals therebetween, wherein the generator motor, the electric storage device, and the control device are disposed in an outside space on an opposite side of the first vertical plate to the second vertical plate, a front portion cable insertion hole is provided in a front portion of the first vertical plate and a rear portion cable insertion hole is provided in a rear portion of the first vertical plate, and one of the electric power cable and the signal cable is an outside cable laid along a route that passes through only the outside space in a lower position than an upper end of the first vertical plate, while the other cable is a bypass cable laid along a bypass route that extends from the generator motor in a lower position than the upper end of the first vertical plate, passes through the rear portion cable insertion hole into an intermediate space between the first vertical plate and the second vertical plate, and returns to the outside space from the intermediate space through the front portion cable insertion hole.

Further, the present invention provides a hybrid construction machine including a lower propelling body and the upper slewing body described above, which is provided rotatably on the lower propelling body.

According to the present invention, an electric power cable and a signal cable can be laid easily over short distances while suppressing an effect of electromagnetic wave noise on the signal cable.

BEST MODE FOR CARRYING OUT THE INVENTION

An embodiment of the present invention will be described below with reference to the attached drawings. Note that the following embodiment is a specific example of the present invention, and is not intended to limit the technical scope of the present invention.

This embodiment of the present invention will now be described with reference to FIGS. 1 to 4.

Figure 4:
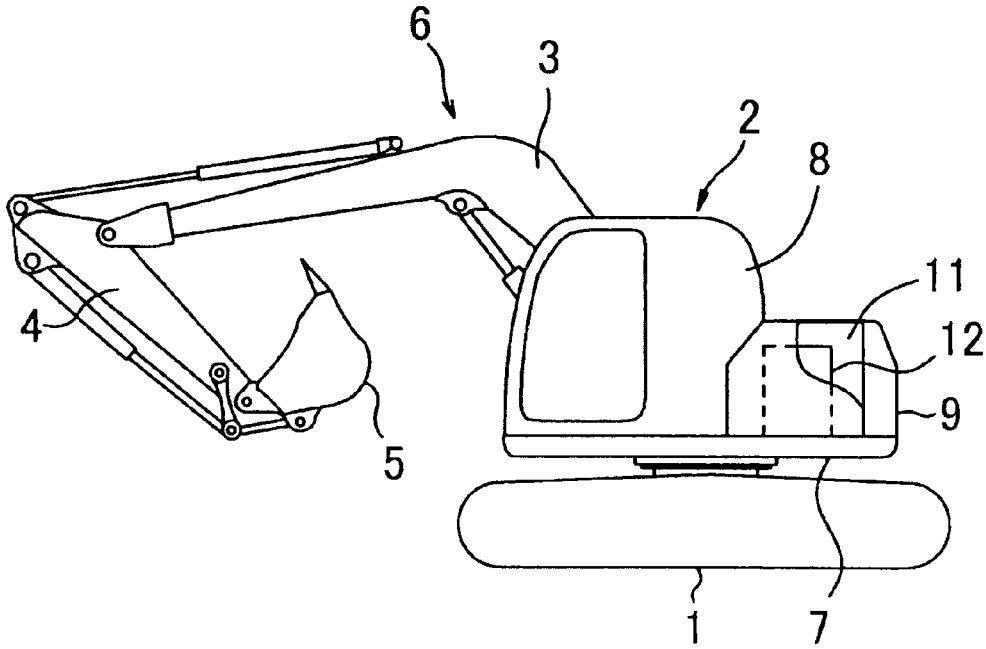
FIG. 4 is a side view showing an overall configuration of a hybrid shovel serving as an example of a hybrid construction machine.
Figure 5:
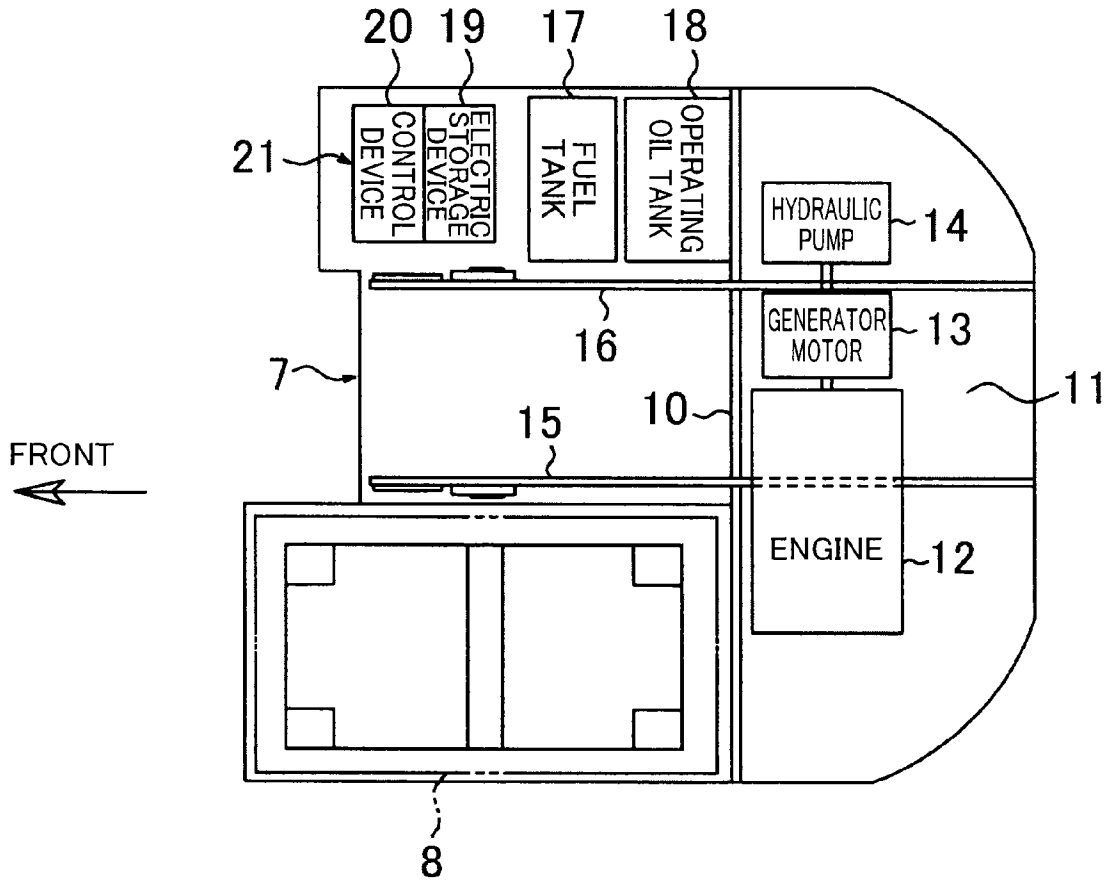
FIG. 5 is a plan view showing an example of a layout of devices on an upper frame, the example being envisaged in the hybrid construction machine shown in FIG. 4.

FIG. 4 is a schematic side view showing an overall configuration of a hybrid shovel serving as an example of a hybrid construction machine according to this embodiment.

The hybrid shovel shown in FIG. 4 includes a crawler type lower propelling body 1, an upper slewing body 2 provided on the lower propelling body 1 to be capable of rotating (slewing) about a perpendicular axis to a ground surface, and a working attachment 6 provided on a front portion of the upper slewing body 2.

The working attachment 6 includes a boom 3 having a base end portion that can be attached to the upper slewing body 2 to be capable of being raised and lowered about a horizontal direction axis, an arm 4 having a base end portion that is attached rotatably to a tip end portion of the boom 3, and a bucket 5 attached rotatably to a tip end portion of the arm 4.

Figure 1:
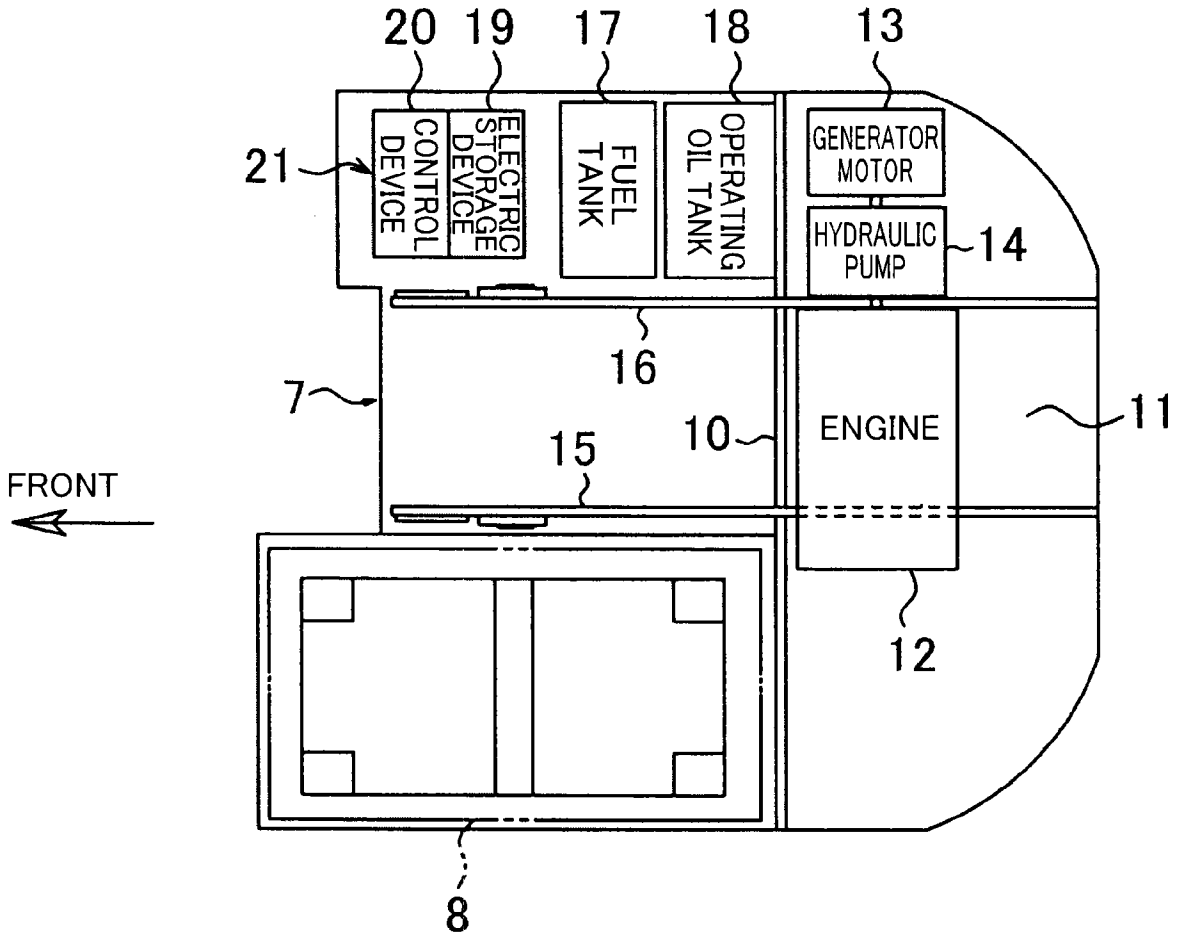
FIG. 1 is a schematic plan view showing an upper frame according to an embodiment of the present invention.
Figure 2:
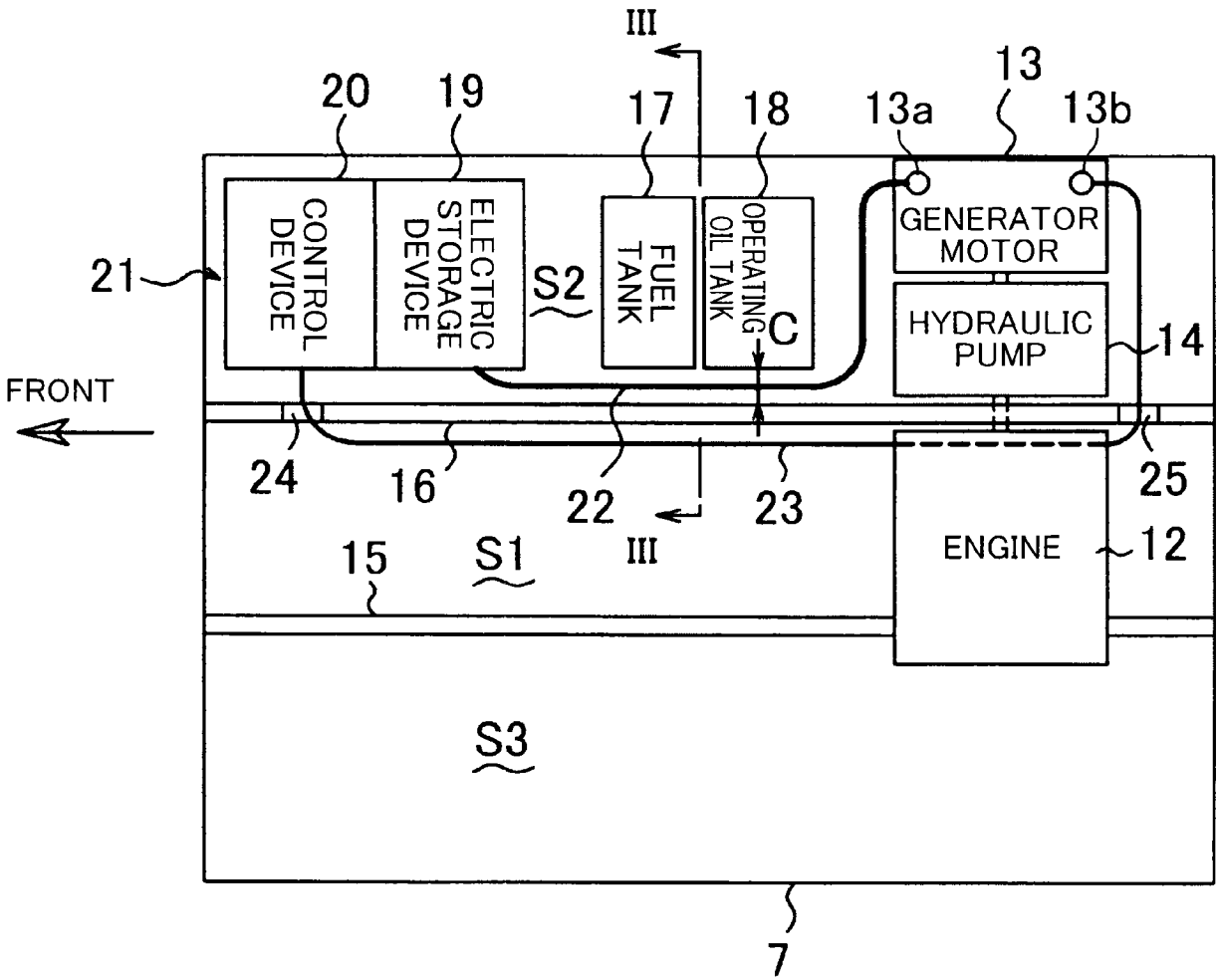
FIG. 2 is a schematic plan view showing a device arrangement and a wiring condition on the frame shown in FIG. 1.

As shown in FIG. 1, the upper slewing body 2 includes an upper frame 7 serving as a base, and a right vertical plate 16, a left vertical plate 15, a cabin 8, a counterweight 9 (see FIG. 4), a partition plate 10, an engine 12, a generator motor 13, a hydraulic pump 14, a fuel tank 17, an operating oil tank 18, an electric storage device 19, a control device 20, an electric power cable 22, and a signal cable 23, which are respectively provided on the upper frame 7.

The respective vertical plates 15, 16 stand on the upper frame 7 in a left-right direction intermediate portion of the upper frame 7 with a left-right direction interval. Further, the respective vertical plates 15, 16 extend over substantially an entire front-rear direction length of the upper frame 7. Moreover, the respective vertical plates 15, 16 has conductivity, in other words a shielding ability relative to electromagnetic wave noise. The base end portion of the boom 3 shown in FIG. 4 is attached to front portions of the vertical plates 15, 16.

A space on the upper frame 7 is divided by the vertical plates 15, 16 into three following spaces. An intermediate space S1 is sandwiched between the vertical plates 15, 16. A right outside space S2 is on an opposite side of the right vertical plate 16 to the left vertical plate 15. A left outside space S3 is on an opposite side of the left vertical plate 15 to the right vertical plate 16.

The cabin 8 is provided on a front portion left side of the upper frame 7.

The counterweight 9 is provided on an end of the upper frame 7.

The partition plate 10 extends in the left-right direction behind the cabin 8. As a result, an engine room 11 is formed between the partition plate 10 and the counterweight 9.

The engine 12 is disposed in a rear portion of the upper frame 7, more specifically in the engine room 11. Further, the engine 12 is disposed in a lateral attitude such that an output shaft thereof extends in the left-right direction.

The hydraulic pump 14 supplies pressurized oil to a hydraulic actuator (for example, a hydraulic cylinder for operating the working attachment 6). More specifically, a drive shaft of the hydraulic pump 14 is coupled to the output shaft of the engine 12. As a result, the hydraulic pump 14 is driven by power from the engine 12. In this embodiment, the hydraulic pump 14 is disposed on the right side of the engine 12.

The generator motor 13 is provided in the rear portion of the upper frame 7 on one side (the right side in this embodiment) of the engine 12 in the left-right direction. In this embodiment, the generator motor 13 is disposed on the right side of the hydraulic pump 14. The generator motor 13 is capable of operating as both a generator and a motor. More specifically, a drive shaft of the generator motor 13 is coupled to the output shaft of the engine 12. As a result, the generator motor 13 can be operated as a generator by the power of the engine 12. Further, the generator motor 13 can be operated as a motor by electric power from the electric storage device.

The fuel tank 17 is disposed on the right side of the right vertical plate 16 in front of the partition plate 10.

The operating oil tank 18 is disposed on the right side of the right vertical plate 16 between the fuel tank 17 and the partition plate 10. In other words, the fuel tank 17 and the operating oil tank 18 are arranged in a front-rear direction.

The electric storage device 19 is disposed on a front portion right side of the upper frame 7. More specifically, the electric storage device 19 is disposed on the right side of the right vertical plate 16 in front of the fuel tank 17. The electric storage device 19 serves as a power source for operating the generator motor 13 as a motor. In other words, the electric storage device 19 is capable of supplying electric power to the generator motor 13.

The control device 20 is provided in the front portion of the upper frame 7. More specifically, the control device 20 is disposed on the right side of the right vertical plate 16 in front of the electric storage device 19. The control device 20 controls operations of the electric storage device 19 and the generator motor 13.

In other words, the generator motor 13, the electric storage device 19, and the control device 20 constitute hybrid devices. Of these hybrid devices, the generator motor 13 is disposed in the rear portion of the upper frame 7 while the electric storage device 19 and the control device 20 are disposed in the front portion of the upper frame 7. A reference numeral "21" denotes a front portion hybrid device including the electric storage device 19 and the control device 20.

The electric power cable 22 connects the electric storage device 19 and the generator motor 13 to each other in order to transmit electric power therebetween.

The signal cable 23 connects the control device 20 and the generator motor 13 to each other in order to transmit signals therebetween.

Differences with the configuration shown in FIG. 6 will now be described.

The generator motor 13 according to this embodiment is disposed in the right outside space S2 together with the hydraulic pump 14.

In other words, the generator motor 13, the electric storage device 19, and the control device 20 are disposed in the right outside space S2. More specifically, the generator motor 13 is disposed in a rear portion of the right outside space S2, and the front portion hybrid device 21 is disposed in a front portion of the right outside space S2.

Note that in this embodiment, the hydraulic pump 14 is disposed on a side close to the engine 12 and the generator motor 13 is disposed on a side far from the engine 12. However, this arrangement may be reversed.

Figure 6:
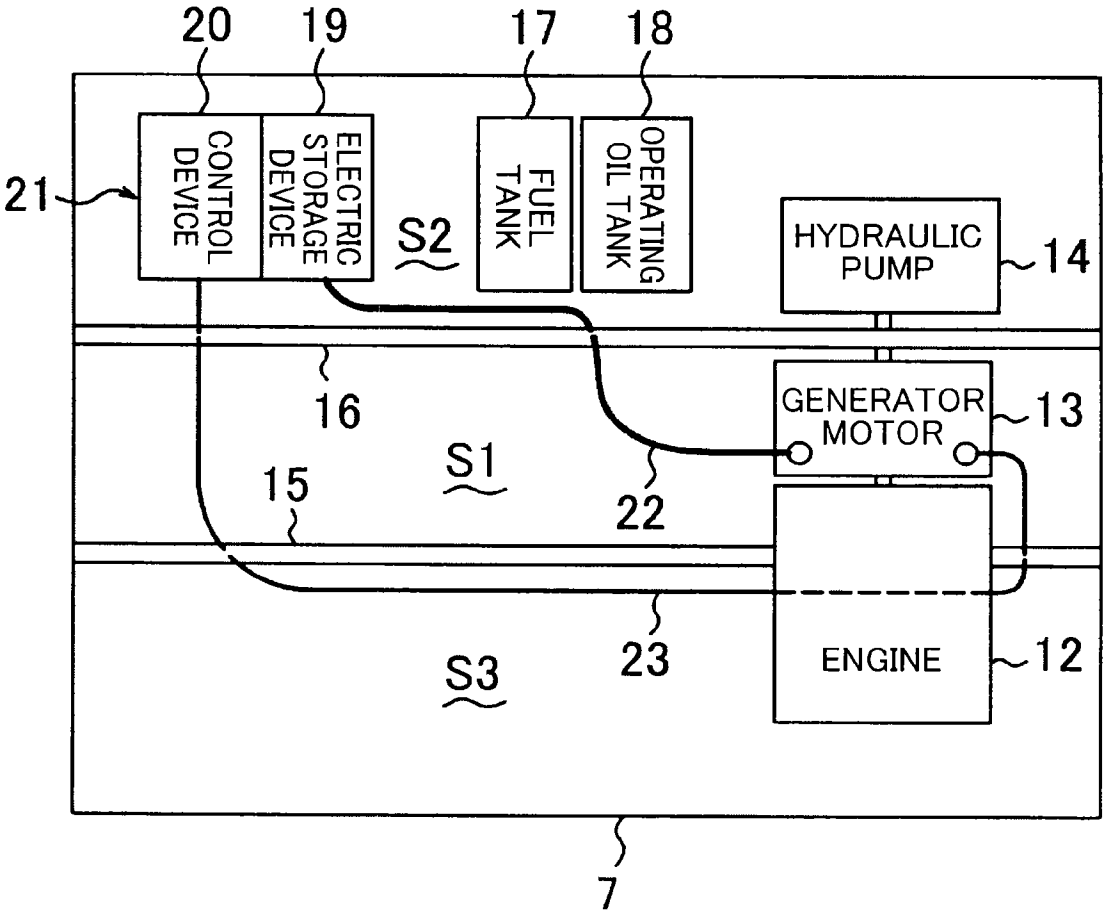
FIG. 6 is a schematic plan view showing an example of wiring in an electric power system and a signal system for connecting the devices on the upper frame, the example being envisaged in the hybrid construction machine shown in FIGS. 4 and 5.

Further, wiring routes for the respective cables 22, 23 according to this embodiment differ from the wiring routes shown in FIG. 6.

More specifically, the electric power cable 22 is laid as an external cable along a route that passes through only the right outside space S2 in a lower position than an upper end of the right vertical plate 16.

To describe this in further detail, the electric power cable 22 is laid along a route that extends from the generator motor 13 to the front portion hybrid device 21 (the electric storage device 19) along a right side surface of the right vertical plate 16 in the right outside space S2. More specifically, a midway portion of the electric power cable 22 is laid to pass through a gap C formed between the right vertical plate 16, and the fuel tank 17 and operating oil tank 18. The fuel tank 17 and the operating oil tank 18 are both formed from steel plate, which is a conductor, and therefore serve as members for blocking electromagnetic wave noise generated by the electric power cable 22.

Note that in this embodiment, a connection position 13*a* in which the electric power cable 22 is connected to the generator motor 13 is disposed further frontward than a connection position 13*b* in which the signal cable 23 is connected to the generator motor 13. Furthermore, the electric storage device 19 connected to the electric power cable 22 is disposed behind the control device 20 connected to the signal cable 23. As a result, the electric power cable 22 can be shortened.

Moreover, in this embodiment, a front portion cable insertion hole 24 is provided in a front portion of the right vertical plate 16, i.e. a device disposal side, and a rear portion cable insertion hole 25 is provided in a rear portion of the right vertical plate 16.

The signal cable 23 is laid as a bypass cable along a route that starts from the right outside space S2 and returns to the right outside space via the intermediate space S1 in a lower position than the upper end of the right vertical plate 16. More specifically, the signal cable 23 is laid along a bypass route that starts from the rear portion of the right outside space S2 (the generator motor 13), passes through the rear portion cable insertion hole 25 into the intermediate space S1, and then returns to the front portion of the right outside space S2 (the front portion hybrid device 21, i.e. the control device 20) from the intermediate space S1 through the front portion cable insertion hole 24. In more detail, the signal cable 23 is laid along the left side surface of the right vertical plate 16 in the intermediate space S1.

In this embodiment, the front portion cable insertion hole 24 is provided in a position to the side of the control device 20 of the front portion hybrid device 21 to which the signal cable 23 is connected. As a result, front portions of the cables 22, 23 can be prevented from intersecting in the right outside space S2. More specifically, the front portion of the electric power cable 22 extends rearward from the electric storage device 19, whereas the front portion of the signal cable 23 extends sideward from the control device 20 toward the front portion cable insertion hole 24. Further, the rear portion cable insertion hole 25 is provided in a position to the rear of the generator motor 13. As a result, rear portions of the cables 22, 23 can be prevented from intersecting in the right outside space S2. More specifically, the rear portion of the electric power cable 22 extends frontward from the generator motor 13, whereas the rear portion of the signal cable 23 extends rearward from the generator motor 13 toward the rear portion cable insertion hole 25. Note that the rear portions of the cables 22, 23 can also be prevented from intersecting when the rearward cable insertion hole 25 is provided in a position to the side of the generator motor 13.

Figure 3:
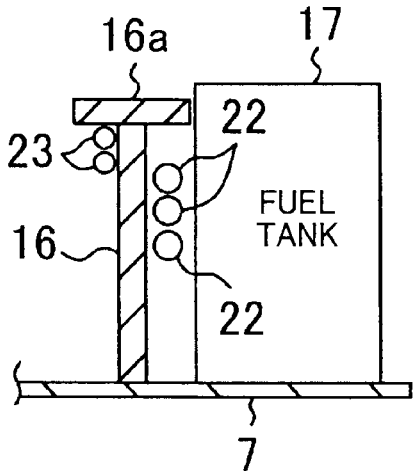
FIG. 3 is an enlarged sectional view taken along a III-III line in FIG. 2.

In this embodiment, as shown in FIG. 3, the respective cables 22, 23 are laid so as to be positioned entirely below the upper end of the right vertical plate 16. As a result, a shielding effect against electromagnetic wave noise can be obtained in the right vertical plate 16.

As shown in FIG. 3, the upper slewing body 2 according to this embodiment further includes an upper plate 16*a* provided on the upper end of the right vertical plate 16. The upper plate 16*a* is attached to the upper end of the right vertical plate 16 such that respective end portions thereof protrude respective left-right direction sides from the right vertical plate 16 horizontally. The respective cables 22, 23 are laid in the vicinity of the right vertical plate 16 below the upper plate 16*a*.

Note that an upper plate provided on the upper end of a vertical plate is a well known. A similar upper plate is provided likewise on the upper end of the left vertical plate 15.

In this embodiment, the generator motor 13, the electric storage device 19, and the control device 20 are disposed in the right outside space S2 on the opposite side of the right vertical plate 16 to the left vertical plate 15. As a result, the electric power cable 22 can be laid along a route that passes through only the right outside space S2. Further, in this embodiment, the front portion cable insertion hole 24 and the rear portion cable insertion hole 25 are formed in the right vertical plate 16. As a result, the signal cable 23 can likewise be laid along a route that passes through only two spaces, namely the right outside space S2 and the intermediate space S1. In other words, the signal cable 23 can be laid along a shorter route than a route that passes through three spaces, as shown in FIG. 6.

Therefore, route lengths of the both cables 22, 23 can be shortened, and as a result, wiring operations for laying the respective cables 22, 23 can be simplified. Furthermore, by reducing the lengths of the both cables 22, 23, a required cost of the wiring can be reduced.

Furthermore, the both cables 22, 23 are shielded from electromagnetic wave noise in large parts of their respective routes by the conductive right vertical plate 16. Therefore, an effect of the electromagnetic wave noise received by the signal cable 23 from the electric power cable 22 can be suppressed.

In this embodiment in particular, the wiring route of the electric power cable 22, which is thicker than the signal cable 23, can be shortened by the greatest amount. As a result, the effects of simplifying the wiring operation and reducing the cost of the wiring are enhanced.

Moreover, the both cables 22, 23 are laid in the vicinity of the right vertical plate 16 below the upper plate 16*a* provided on the upper end of the right vertical plate 16. In other words, the both cables 22, 23 are laid such that the upper plate 16*a* covers the both cables 22, 23 in the manner of an umbrella. Hence, the upper plate 16*a* functions as a barrier that blocks electromagnetic wave noise, and therefore a protective effect on the signal cable 23 can be further enhanced. More specifically, electromagnetic wave noise from the electric power cable 22 that attempts to reach the signal cable 23 by passing above the right vertical plate 16 is blocked by the upper plate 16*a*.

Further, the electric power cable 22 is laid to pass through the gap C between the operating oil tank 18 and fuel tank 17, and the right vertical plate 16 which are constituted by conductors. In other words, the electric power cable 22 is sandwiched between the right vertical plate 16, and the operating oil tank 18 and fuel tank 17. Hence, an effective range of the electromagnetic wave noise generated by the electric power cable 22 can be narrowed. As a result, the protective effect on the signal cable 23 can be further enhanced.

In this embodiment, the connection position 13*a* in which the electric power cable 22 is connected to the generator motor 13 is disposed further frontward than the connection position 13*b* in which the signal cable 23 is connected to the generator motor 13, and the electric storage device 19 is disposed behind the control device 20. Hence, connection positions of respective ends of the electric power cable 22 can be brought closer together in the front-rear direction, and therefore the electric power cable 22 can be shortened even further. As a result, simplification of the wiring operation and a reduction in the wiring cost can be realized even more effectively.

In this embodiment, the rear portion cable through hole 25 is disposed behind the generator motor 13. Hence, the rear portion of the electric power cable 22 and the rear portion of the signal cable 23 can be prevented from intersecting in the right outside space S2. More specifically, the rear portion of the electric power cable 22 extends frontward from the generator motor 13, whereas the rear portion of the signal cable 23 extends rearward from the generator motor 13 toward the rear portion cable insertion hole 25. In other words, wiring directions of the rear portions of the respective cables 22, 23 can be set in different directions to each other. As a result, the effect of the electromagnetic wave noise received by the signal cable 23 from the electric power cable 22 can be further reduced.

In this embodiment, the front portion cable insertion hole 24 is disposed to the side of the control device 20 connected to the signal cable 23. As a result, the front portion of the electric power cable 22 and the front portion of the signal cable 23 can be prevented from intersecting in the right outside space S2. More specifically, the front portion of the electric power cable 22 extends rearward from the electric storage device 19, whereas the front portion of the signal cable 23 extends sideward from the control device 20 toward the front portion cable insertion hole 24. In other words, wiring directions of the front portions of the respective cables 22, 23 can be set in different directions to each other. As a result, the effect of the electromagnetic wave noise received by the signal cable 23 from the electric power cable 22 can be further reduced.

Other Embodiments (1) Only one of the fuel tank 17 and the operating oil tank 18 may be formed from a conductor. In this case, only the tank formed from a conductor may be used as the shielding member for blocking electromagnetic wave noise.

(2) In contrast to the above embodiment, the electric power cable 22 may be laid as the bypass cable along the bypass route passing through the right outside space S2 and the intermediate space S1, and the signal cable 23 may be laid as the outside cable along the route passing through the right outside space S2 alone. In this case, the signal cable 23 can be shortened by disposing the connection position 13*b* of the signal cable 23 in front of the connection position 13*a* of the electric power cable 22 and disposing the control device 20 behind the electric storage device 19. Further, the front portions of the cables 22, 23 can be prevented from intersecting in the right outside space S2 by providing the front portion cable insertion hole 24 in a position to the side of the electric storage device 19.

(3) In the above embodiment, the present invention is applied to a typical shovel in which the cabin is disposed on the left side, but the present invention may be applied to a shovel in which the cabin is disposed on the right side. In this case, the generator motor 13 may be disposed in a left side rear portion of the upper frame 7, and the hybrid device 21 may be disposed in a left side front portion of the upper frame 7. Further, one of the both cables 22, 23 may be laid along a route passing through only the left outside space S3, and the other cable may be laid along a route passing through the left outside space S3 and the intermediate space S1.

(4) The present invention is not limited to a shovel, and may be applied widely to other hybrid construction machines such as a hybrid dismantling machine or a hybrid breaker which incorporates a shovel as a parent body.

Note that the specific embodiment described above mainly includes inventions having following configurations.

The present invention provides an upper slewing body for a hybrid construction machine, which is provided rotatably on a lower propelling body, and the upper slewing body including: an upper frame; a first vertical plate and a second vertical plate forming a left-right pair and having conductivity, which stand on the upper frame in a left-right direction intermediate portion of the upper frame with a left-right direction interval, and extend over substantially an entire front-rear direction length of the upper frame; an engine provided in a rear portion of the upper frame; a generator motor that is provided in the rear portion of the upper frame and can be operated as a generator using power from the engine; an electric storage device that is provided in a front portion of the upper frame and constitutes a power source for operating the generator motor as a motor; a control device provided in the front portion of the upper frame to control operations of the electric storage device and the generator motor; an electric power cable that connects the electric storage device to the generator motor in order to transmit electric power therebetween; and a signal cable that connects the control device to the generator motor in order to transmit signals therebetween, wherein the generator motor, the electric storage device, and the control device are disposed in an outside space on an opposite side of the first vertical plate to the second vertical plate, a front portion cable insertion hole is provided in a front portion of the first vertical plate and a rear portion cable insertion hole is provided in a rear portion of the first vertical plate, and one of the electric power cable and the signal cable is an outside cable laid along a route that passes through only the outside space in a lower position than an upper end of the first vertical plate, while the other cable is a bypass cable laid along a bypass route that extends from the generator motor in a lower position than the upper end of the first vertical plate, passes through the rear portion cable insertion hole into an intermediate space between the first vertical plate and the second vertical plate, and returns to the outside space from the intermediate space through the front portion cable insertion hole.

In the present invention, the generator motor, the electric storage device, and the control device are disposed in the outside space on the opposite side of the first vertical plate to the second vertical plate. As a result, the outside cable, which is one of the electric power cable and the signal cable, can be laid along the route that passes through only the outside space. Further, in the present invention, the front portion cable insertion hole and the rear portion cable insertion hole are formed in the first vertical plate. As a result, the bypass cable, from among the electric power cable and the signal cable, can be laid along a route that passes through only two spaces, i.e. the outside space and the intermediate space. In other words, the bypass cable can be laid along a shorter bypass route than a route that passes through three spaces as shown in FIG. 6.

Hence, respective route lengths of the electric power cable and the signal cable can be shortened, and as a result, wiring operations for laying the electric power cable and the signal cable can be simplified. Further, by shortening the lengths of the electric power cable and the signal cable, a cost of the wiring can be reduced.

Moreover, the outside cable and the bypass cable are shielded from electromagnetic wave noise in large parts of their respective routes by the first vertical plate having conductivity. As a result, an effect of the electromagnetic wave noise received by the signal cable from the electric power cable can be suppressed.

In this upper slewing body, the outside cable is preferably the electric power cable.

According to this aspect, the wiring route of the electric power cable, which is thicker than the signal cable, can be shortened by the greatest amount. As a result, the effects of simplifying the wiring operation and reducing the cost of the wiring are enhanced.

This upper slewing body preferably further includes an upper plate provided on the upper end of the first vertical plate such that respective end portions thereof protrude respective left-right direction sides from the first vertical plate, wherein the outside cable and the bypass cable are laid below the upper plate in the vicinity of the first vertical plate.

According to this aspect, the upper plate functions as a barrier that blocks electromagnetic wave noise, and therefore the protective effect on the signal cable can be further enhanced. More specifically, electromagnetic wave noise from the electric power cable that attempts to reach the signal cable by passing above the first vertical plate is blocked by the upper plate.

This upper slewing body preferably further includes an operating oil tank and a fuel tank provided on the upper frame, wherein at least one of the operating oil tank and the fuel tank is a shielding tank having conductivity, the shielding tank is disposed in the outside space in order to block electromagnetic wave noise, and the outside cable is laid to pass through a gap formed between the shielding tank and the first vertical plate.

According to this aspect, the outside cable is sandwiched between the shielding tank and the first vertical plate, and therefore an effective range of the electromagnetic wave noise generated by the outside cable or the electromagnetic wave noise supplied to the outside cable can be reduced. As a result, the protective effect on the signal cable can be further enhanced.

In this upper slewing body, a connection position in which the outside cable is connected to the generator motor is preferably disposed in front of a connection position in which the bypass cable is connected to the generator motor, and the device connected to the outside cable, from among the electric storage device and the control device, is preferably disposed behind the device connected to the bypass cable.

According to this aspect, connection positions of respective ends of the outside cable can be brought closer together in the front-rear direction, and therefore the outside cable can be shortened even further. As a result, simplification of the wiring operation and a reduction in the wiring cost can be realized even more effectively.

In this upper slewing body, the rear portion cable insertion hole is preferably disposed to a side of or behind the generator motor.

According to this aspect, a rear portion of the outside cable and a rear portion of the bypass cable can be prevented from intersecting in the outside space. More specifically, the rear portion of the outside cable extends frontward from the generator motor, whereas the rear portion of the bypass cable extends sideward or rearward from the generator motor toward the rear portion cable insertion hole. In other words, wiring directions of the rear portions of the respective cables can be set in different directions to each other. As a result, the effect of the electromagnetic wave noise received by the signal cable from the electric power cable can be further reduced.

In this upper slewing body, the front portion cable insertion hole is preferably disposed to a side of the device connected to the bypass cable, from among the electric storage device and the control device.

According to this aspect, the front portion of the outside cable and the front portion of the bypass cable can be prevented from intersecting in the outside space. More specifically, the front portion of the outside cable extends rearward from the electric storage device or the control device, whereas the front portion of the bypass cable extends sideward from the electric storage device or the control device toward the front portion cable insertion hole. In other words, wiring directions of the front portions of the respective cables can be set in different directions to each other. As a result, the effect of the electromagnetic wave noise received by the signal cable from the electric power cable can be further reduced.

The present invention further provides a hybrid construction machine including: a lower propelling body; and the upper slewing body described above, which is provided rotatably on the lower propelling body.

INDUSTRIAL APPLICABILITY

According to the present invention, an electric power cable and a signal cable can be laid easily over short distances while suppressing an effect of electromagnetic wave noise on the signal cable.

S1 intermediate space
S2 right outside space (example of outside space)
S3 left outside space (example of outside space)
1 lower propelling body
2 upper slewing body
7 upper frame
9 counterweight
12 engine
13 generator motor
13*a* connection position
13*b* connection position
15 left vertical plate
16 right vertical plate
16*a* upper plate
17 fuel tank
18 operating oil tank
19 electric storage device
20 control device
22 electric power cable
23 signal cable
24 front portion cable insertion hole
25 rear portion cable insertion hole

The invention claimed is:

1. An upper slewing body for a hybrid construction machine, which is provided rotatably on a lower propelling body, comprising:

an upper frame;

a first vertical plate and a second vertical plate forming a left-right pair and having conductivity, which stand on the upper frame in a left-right direction intermediate portion of the upper frame with a left-right direction interval, and extend over substantially an entire front-rear direction length of the upper frame;

an engine provided in a rear portion of the upper frame;

a generator motor that is provided in the rear portion of the upper frame and can be operated as a generator using power from the engine;

an electric storage device that is provided in a front portion of the upper frame and constitutes a power source for operating the generator motor as a motor;

a control device provided in the front portion of the upper frame to control operations of the electric storage device and the generator motor;

an electric power cable that connects the electric storage device to the generator motor in order to transmit electric power therebetween; and a signal cable that connects the control device to the generator motor in order to transmit signals therebetween, wherein the generator motor, the electric storage device, and the control device are disposed in an outside space on an opposite side of the first vertical plate to the second vertical plate, a front portion cable insertion hole is provided in a front portion of the first vertical plate and a rear portion cable insertion hole is provided in a rear portion of the first vertical plate, and one of the electric power cable and the signal cable is an outside cable laid along a route that passes through only the outside space in a lower position than an upper end of the first vertical plate, while the other cable is a bypass cable laid along a bypass route that extends from the generator motor in a lower position than the upper end of the first vertical plate, passes through the rear portion cable insertion hole into an intermediate space between the first vertical plate and the second vertical plate, and returns to the outside space from the intermediate space through the front portion cable insertion hole.

2. The upper slewing body for a hybrid construction machine according to claim 1, wherein the outside cable is the electric power cable.

3. The upper slewing body for a hybrid construction machine according to claim 1, further comprising an upper plate provided on the upper end of the first vertical plate such that respective end portions thereof protrude respective left-right direction sides from the first vertical plate, wherein the outside cable and the bypass cable are laid below the upper plate in the vicinity of the first vertical plate.

4. The upper slewing body for a hybrid construction machine according to claim 1, further comprising an operating oil tank and a fuel tank provided on the upper frame, wherein at least one of the operating oil tank and the fuel tank is a shielding tank having conductivity, the shielding tank is disposed in the outside space in order to block electromagnetic wave noise, and the outside cable is laid to pass through a gap formed between the shielding tank and the first vertical plate.

5. The upper slewing body for a hybrid construction machine according to claim 1, wherein a connection position in which the outside cable is connected to the generator motor is disposed in front of a connection position in which the bypass cable is connected to the generator motor, and the device connected to the outside cable, from among the electric storage device and the control device, is disposed behind the device connected to the bypass cable.

6. The upper slewing body for a hybrid construction machine according to claim 5, wherein the rear portion cable insertion hole is disposed to a side of or behind the generator motor.

7. The upper slewing body for a hybrid construction machine according to claim 5, wherein the front portion cable insertion hole is disposed to a side of the device connected to the bypass cable, from among the electric storage device and the control device.

8. A hybrid construction machine comprising:

a lower propelling body; and the upper slewing body according to claim 1, which is provided rotatably on the lower propelling body.

* * * * *